United States Patent [19]

Takeda et al.

[11] Patent Number: 4,922,303

[45] Date of Patent: May 1, 1990

[54] IMAGE FORMING APPARATUS WITH CORONA DISCHARGE DEVICE FOR TRANSFERRING TONER IMAGE

[75] Inventors: Katsuhiko Takeda; Hisashi Myochin, both of Osaka, Japan

[73] Assignee: Minolta Camera Kabushiki Kaisha, Osaka, Japan

[21] Appl. No.: 232,646

[22] Filed: Aug. 16, 1988

[30] Foreign Application Priority Data

Aug. 21, 1987 [JP] Japan ..... 62-208695

[51] Int. Cl.[5] ..... G03G 15/16

[52] U.S. Cl. ..... 355/274; 355/221

[58] Field of Search ..... 250/324, 325; 355/3 CH, 355/3 TR, 14 TR

[56] References Cited

U.S. PATENT DOCUMENTS

| | | | |
|---|---|---|---|
| 3,620,617 | 11/1971 | Kelly et al. | 355/3 DD |
| 3,777,158 | 12/1973 | Kamogawa et al. | 250/324 |
| 3,794,839 | 2/1974 | Hayne | 250/324 |
| 3,850,519 | 11/1974 | Weikel, Jr. | 355/3 R |
| 4,178,092 | 12/1979 | Yamamoto et al. | 250/324 X |
| 4,575,329 | 3/1986 | Ahlbrandt | 50/325 X |

FOREIGN PATENT DOCUMENTS

| | | | |
|---|---|---|---|
| 0118136 | 10/1978 | Japan | 355/3 TR |
| 59-68364 | 5/1984 | Japan . | |
| 60-14274 | 5/1985 | Japan . | |
| 0213868 | 10/1986 | Japan | 355/3 CH |

*Primary Examiner*—A. T. Grimley

*Assistant Examiner*—Robert Beatty

*Attorney, Agent, or Firm*—Wenderoth, Lind & Ponack

[57] ABSTRACT

An image forming apparatus has a corona discharge device for transferring a toner image formed on a photosensitive member onto paper and a suction fan for drawing air from the inside of the corona discharge device to exhaust ozone. The corona discharge device has a wire electrode, a shield member surrounding the wire electrode including a lower portion located on the opposite side to the photosensitive member with respect to the wire electrode and a pair of side portions extending from the respective side edges of the lower portion toward the photosensitive member, and a cover member located between the photosensitive member and the wire electrode and extending downstream from the upstream side of the wire electrode with respect to the direction of transport of the paper to cover a part of the upper side of the wire electrode, the remaining part of the upper side of the wire electrode being used for transferring the toner image by corona discharge. The shield member is formed with a first opening in the lower portion for drawing air therethrough, and a second opening in one of the side portions at a position near the photosensitive member. With the above arrangement, air flows through the remaining part of the upper side of the wire electrode and also through the second opening into the corona discharge device and then flows out through the first opening by being drawn by the suction fan.

13 Claims, 7 Drawing Sheets

IMAGE FORMING APPARATUS WITH CORONA DISCHARGE DEVICE FOR TRANSFERRING TONER IMAGE

FIELD OF THE INVENTION

The present invention relates to an image forming apparatus of the toner image transfer type, and more particularly to improvements in corona discharge devices for transferring to a toner image onto paper.

BACKGROUND OF THE INVENTION

Electrophotographic copying machines and the like usually include a corona discharge device for transferring toner images formed on a photosensitive member onto paper. The use of a corona discharge device nevertheless involves a problem in that ozone produced by the discharge exerts an adverse influence on the photosensitive member.

FIG. 1 shows a corona discharge device 1*a* already proposed to overcome this problem. This known corona discharge device 1*a* is disposed under a photosensitive drum 2*a* and has a discharge wire 11*a* extending axially of the drum 2*a* and a stabilizer plate 12*a* surrounding the discharge wire 11*a* on opposite lateral side and on a lower side. The stabilizer plate 12*a* is formed at its bottom with an ozone discharge opening 13*a* for drawing air therethrough to discharge ozone from the device.

With the device 1*a*, however, paper P close an hopening 14*a* in the upper side of the device 1*a* when passing over the opening 14*a*, consequently impeding the flow of air therethrough to produce a negative pressure within the device 1*a*. Accordingly, the device has the drawback that the rear end of the paper P, when passing between the device 1*a* and the drum 2*a*, is separated from the drum 2*a*, making it impossible for the device to transfer the toner image properly.

SUMMARY OF THE INVENTION

Accordingly, the primary object of the present invention is to provide an image forming apparatus with an improved corona discharge device for transferring toner images to paper.

Another object of the invention is to provide an image forming apparatus with an improved corona discharge device which is operable to properly transfer toner images to paper at all times and which is adapted to effectively exhaust ozone generated by corona discharge.

The foregoing objects can be well fulfilled according to the present invention by providing an image forming apparatus which has a corona discharge device for transferring a toner image forming on a toner image carrier onto paper, the corona discharge device having a wire electrode, and a shield member surrounding the wire electrode. The shield member includes a lower portion located opposite the toner image carrier with respect to the wire electrode, and a pair of side portions extending from the respective side edges of the lower portion toward the toner image carrier. The shield member has a first opening in the lower portion and a second opening in one of the side portions at a position near the toner image carrier. A cover member is located between the toner image carrier and the wire electrode and extends downstream from the upstream side of the wire electrode with respect to the direction of transport of the paper to cover a part of the upper side of the wire electrode. The remaining part of the upper side of the wire electrode is used for transferring the toner image by corona discharge. The image forming apparatus further has an apparatus for sucking air from the inside of the shield member through the first opening, thus permitting air to flow into the shield member through the second opening and also through the remaining part from outside.

BRIEF DESCRIPTION OF THE DRAWINGS

The above and other objects or features of the present invention will become apparent from the following description of preferred embodiments thereof taken in conjunction with the accompanying drawings, in which:

FIG. 5 (*b*) and FIG. 6 (*b*) are, respectively, a diagram showing lines of electric force and a diagram of transfer current values in the transfer region in the case where the stabilizer plate of the transfer device has no opening in a side portion thereof.

In the following description, like parts are designated by like reference numbers throughout the several drawings.

DESCRIPTION OF THE PREFERRED EMBODIMENTS

Embodiments of the invention will be described below.

Figure 1:
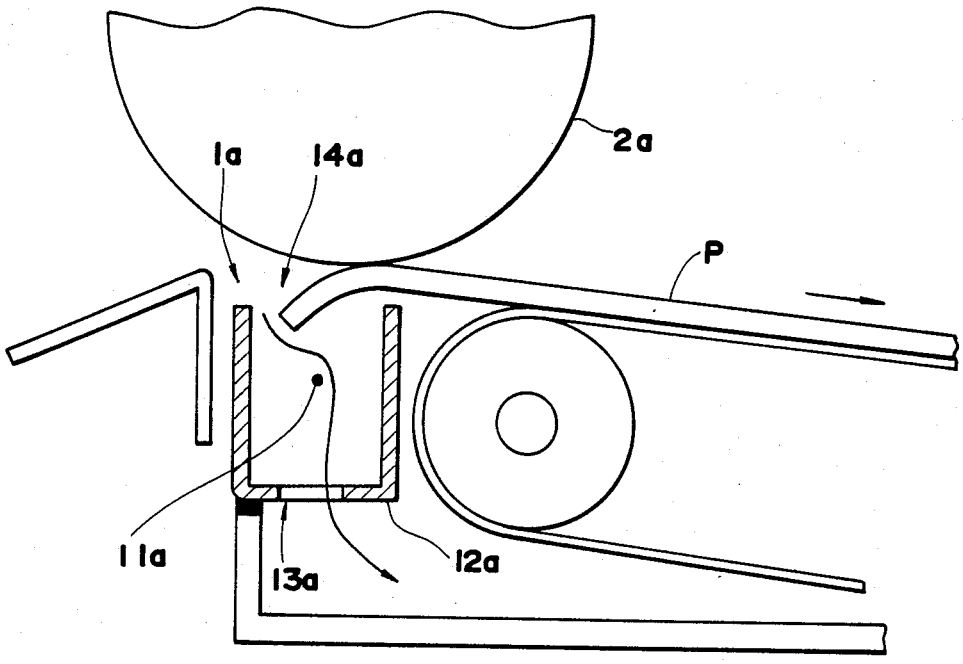
FIG. 1 PRIOR ART
FIG. 1 is a diagram showing a conventional corona discharge transfer device and its surroundings.
Figure 2:
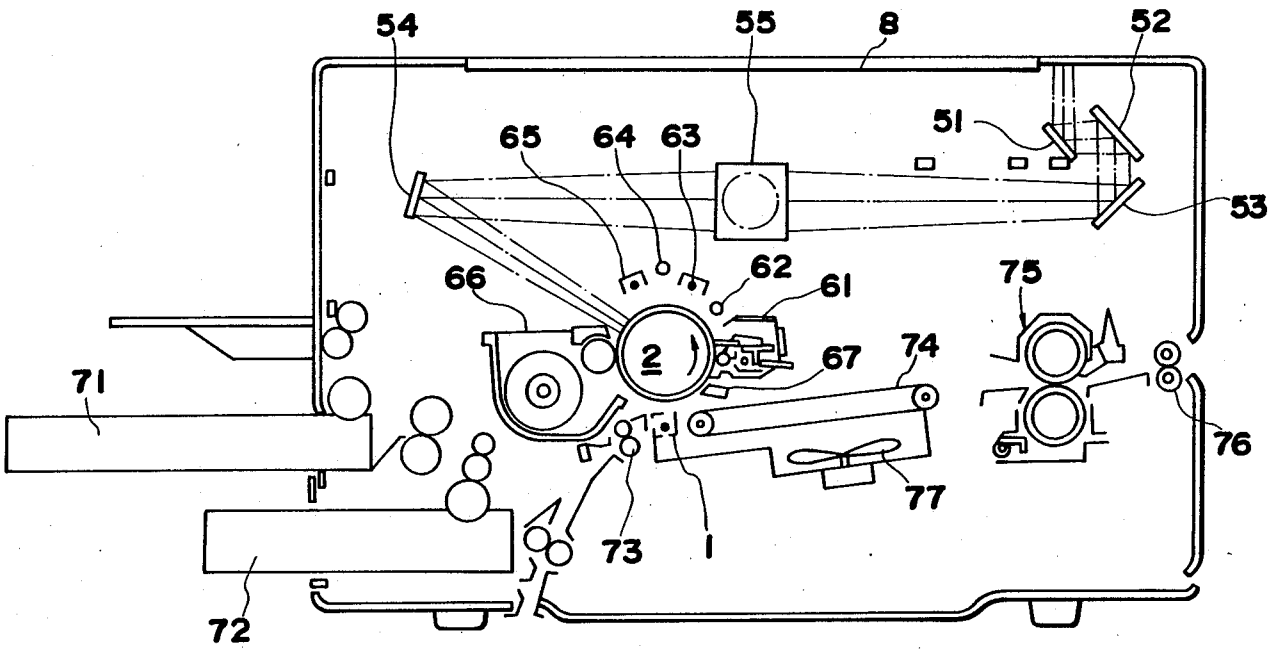
FIG. 2 is a diagram of an image forming apparatus of the toner image transfer type embodying the invention.

FIG. 2 is a diagram schematically showing an image forming apparatus of the toner image transfer type embodying the invention.

With this apparatus, an original is placed on a document table 8 and illuminated with light from a light source (not shown). The light reflected from the original is transmitted to a photosensitive drum 2 through mirrors 51 to 54 and a projection lens 55. The drum 2 has on its surface a photosensitive layer, which is illuminated with eraser lamps 62 and 64, sensitized by chargers 63 and 65, and thereafter exposed to the light from the original to form an electrostatic latent image thereon. The latent image is converted to a visible image with toner by a developing unit 66. The toner image is transferred onto paper by the corona discharge transfer device 1, to be described below in detail. The paper bearing the toner image thereon is separated from the drum 2 by a separating claw 67 and transported by a conveyor belt 74 to a fixing unit 75, in which the toner image is fixed to the surface of the paper. The paper is then discharged from the apparatus by delivery rollers 76. FIG. 2 further shows a cleaner 61, paper cassettes 71 and 72, and a timing roller 73. The conveyor belt 74 is formed with a multiplicity of holes or apertures, through which air is drawn by a suction fan 77, whereby the paper is held attracted to the belt 74 for transport.

Figure 3:
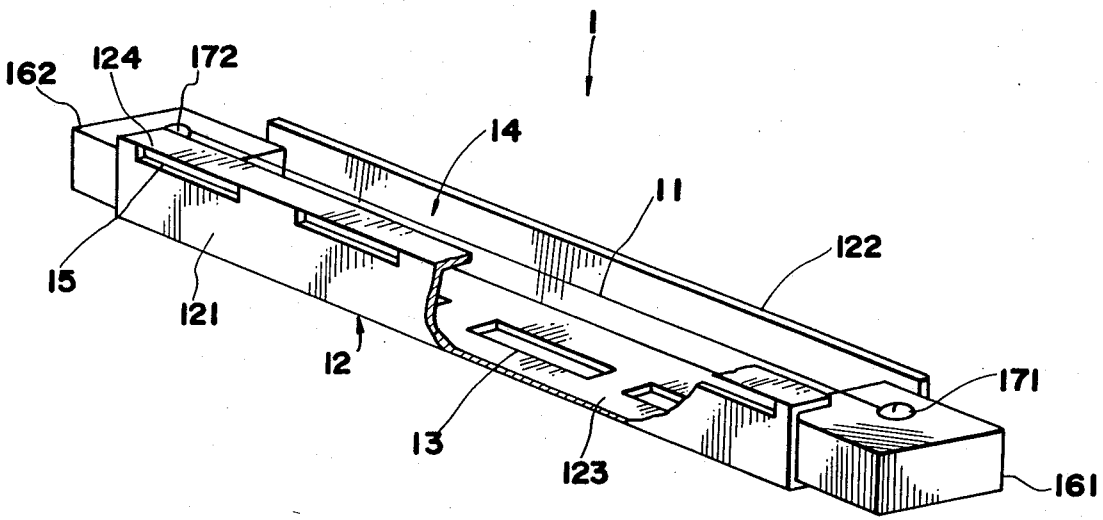
FIG. 3 is a perspective view partly broken away showing a corona discharge transfer device of the image forming apparatus of FIG. 2.
Figure 4:
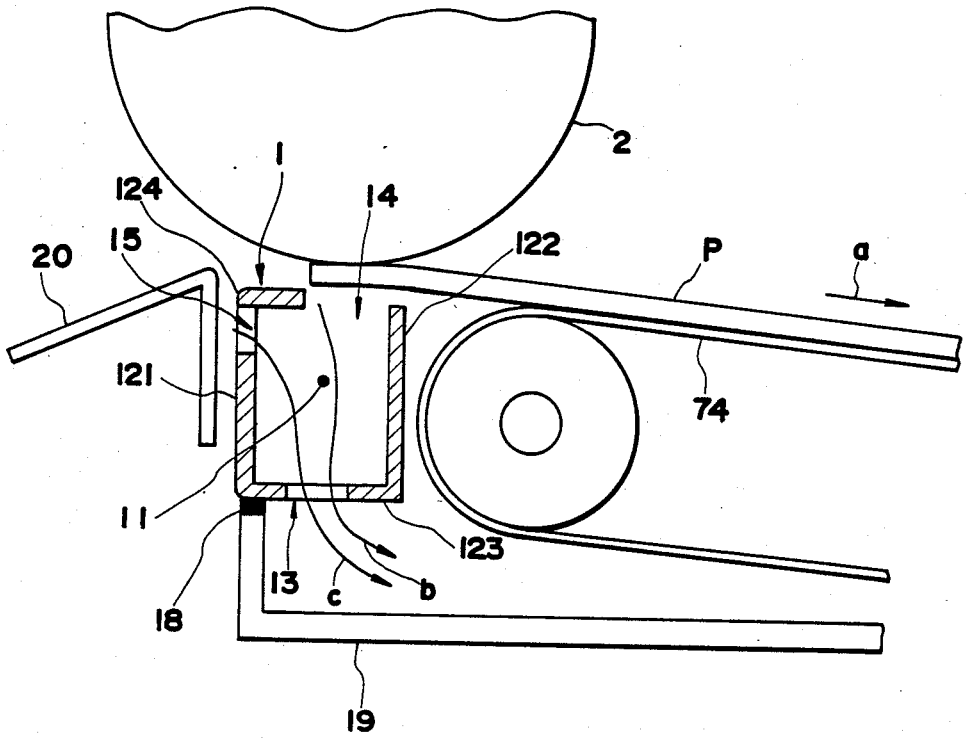
FIG. 4 is a diagram showing the transfer device of FIG. 3 and its surroundings.

With reference to FIGS. 3 and 4, the corona discharge transfer device 1 comprises a discharge wire 11 and a stabilizer plate 12 surrounding the discharge wire 11.

The stabilizer plate 12 includes side portions 121 and 122 covering the discharge wire 11 on opposite lateral sides, a lower portion 123 interconnecting the side portions 121 and 122 at their lower ends for covering the wire 11 on the lower side, and an upper portion 124 extending from the upper end of the side portion 121 to partly cover the wire 11 on the upper side. The lower portion 123 is formed in the middle of its width with five rectangular lower openings 13 longitudinally thereof. The upper portion 124 and the side portion 122 define an upper opening 14 therebetween. The side portion 121 has five side openings 15 formed longitudinally thereof at a location within one-fourth of its entire height as measured vertically from its upper end.

The discharge wire 11 extends through the space surrounded by the stabilizer plate 12 and is fastened by setscrews 171, 172 to insulating blocks 161, 162 provided at the longitudinal opposite ends of the plate.

The corona discharge transfer device 1 is disposed under the photosensitive drum 2 and mounted on a duct housing 19 extending toward the suction fan 77, with a packing 18 provided between the device and the housing. Paper P is transported between the device 1 and the drum 2 from a guide plate 20 toward the conveyor belt 74 in the direction of arrow a shown.

With the above arrangement, air flows through the upper opening 14 opposed to the drum 2 and also through the side openings 15 into the discharge device 1 and then flows out through the lower openings 13 into the duct housing 19 by being drawn by the suction fan 77, as indicated by arrows b and c. Accordingly, even when the paper P passing over the upper opening 14 of the device 1 blocks the flow of air through the opening 14 (arrow b), no negative pressure will be produced within the device 1 owing to the presence of the flow of air through the side openings 15 (arrow c). This obviates the likelihood that the rear end of the paper P will be drawn toward the transfer device 1, assuring the proper transfer of the toner at all times.

The side openings 15 are formed in the side portion 121 of the stabilizer plate 12 in proximity to the drum 2, more specifically, as located within one-fourth of the entire height of the side plate 121 as measured vertically from its upper end. When thus located, the openings permit air to flow continuously from an upper position downward, whereby the ozone generated in the device 1 can be exhausted effectively. If the openings are located otherwise, air will now flow through the device smoothly, failing to fully discharge the ozone. It is undesirable to form an opening in the upper portion 124 since the upper portion 124 serves to preclude early transfer of the toner, that is, to prevent the transfer of the toner onto the paper P at a position other than the contemplated region of transfer.

Figure 5A:
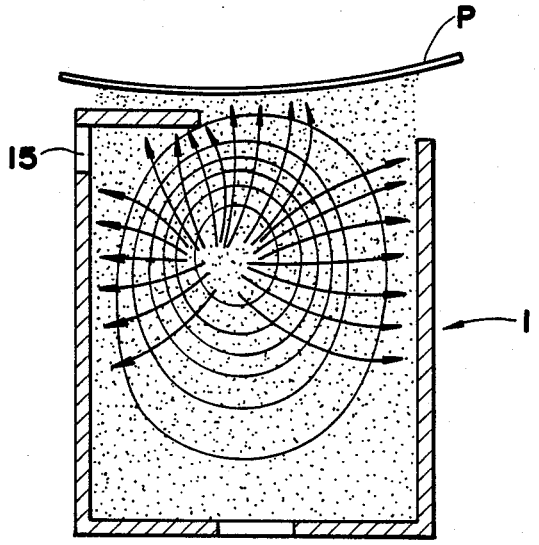
FIG. 5 (*a*) and FIG. 6 (*a*) are, respectively, a diagram showing lines of electric force of the transfer device and a diagram of transfer current values in the transfer region.
Figure 5:
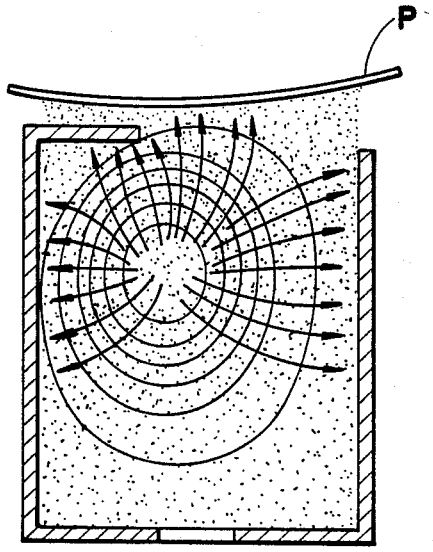
Figure 6A:
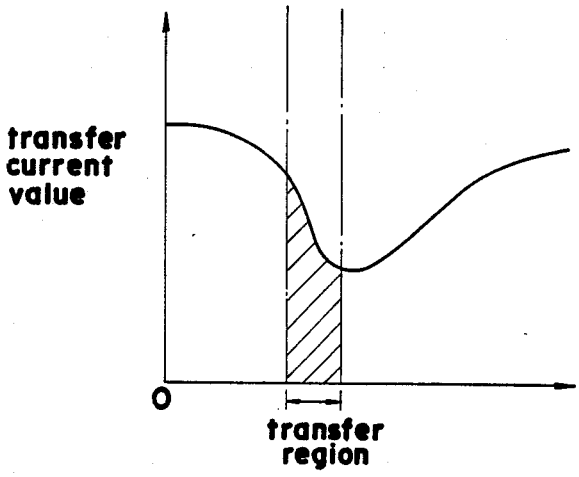
Figure 6B:
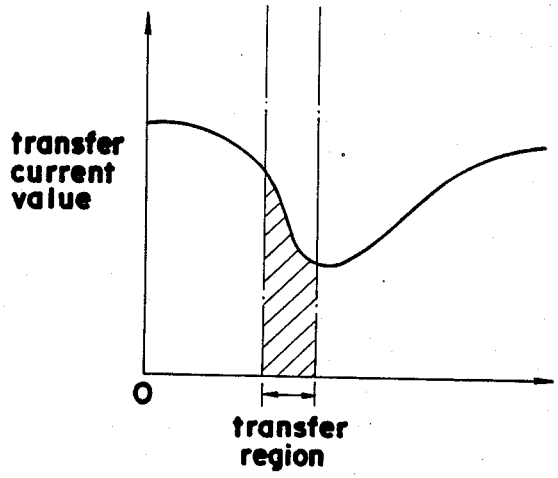

Next, FIG. 5 (*a*) and FIG. 5 (*a*) respectively, show lines of electric force and transfer current values in the transfer region as produced by the present device having the side openings 15. These illustrated results are almost in no way different from the corresponding lines of electric force and transfer current values shown in FIG. 5 (*b*) and FIG. 6 (*b*), respectively, as observed when the device has no side opening 15. The present device is therefore also fully useful with respect to transfer efficiency.

Figure 7:
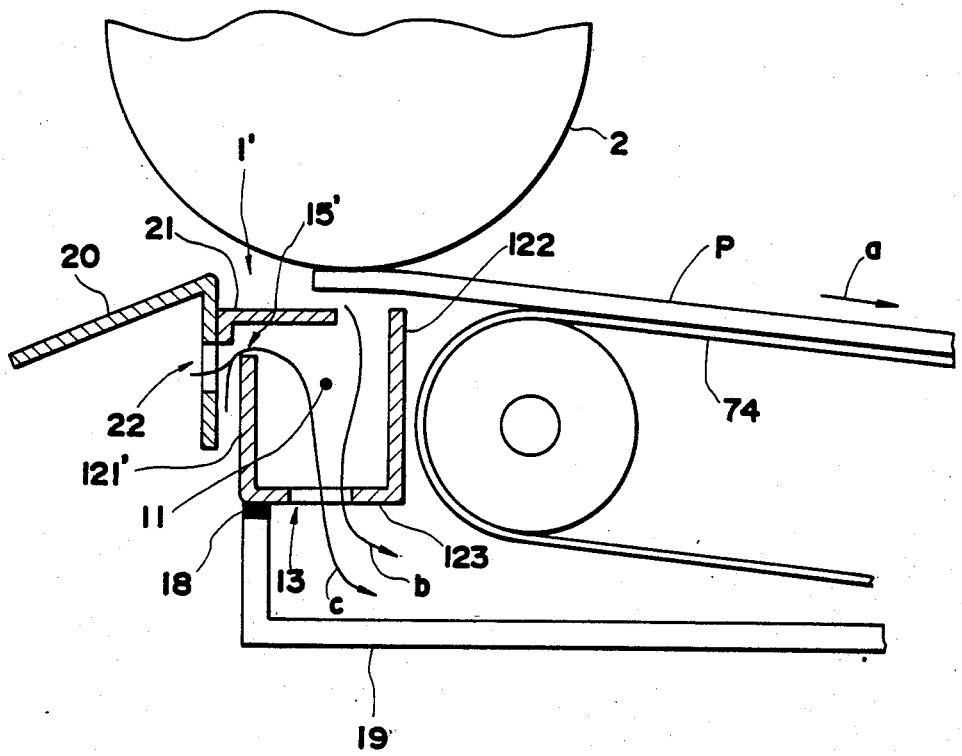
FIG. 7 is a diagram showing a modified corona discharge transfer device and its surroundings.

Instead of the upper portion 124, an early transfer preventing plate 21 may be attached to a guide plate 20 which is provided upstream from a corona discharge transfer device 1' with respect to the direction of transport of paper P, as seen in FIG. 7. The plate 21 may be made of an insulating material or an electrically conductive material. The device 1' has a side portion 121' which is also formed with openings 15' proximate to the photosensitive drum 2, whereby the same effect as already described is available. It is of course desirable to locate the openings 15' within one-fourth of the height of the device as measured from its upper end. Further in the case where the guide plate 20 extends beyond the position opposed to the openings 15', the guide plate 20 may be formed with openings 22 opposed to the openings 15' for passing air therethrough.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus for transferring a toner image onto a paper transported in a paper transport direction, comprising:

a tone image carrier for carrying a toner image thereon;

a corona discharge device for transferring a toner image from said toner image carrier to a paper, said corona discharge device comprising:

a wire electrode disposed adjacent said toner image carrier such that said toner image carrier is on one side of said wire electrode, a shield member surrounding said wire electrode, said shield member including a lower portion disposed on the side of said wire electrode opposite said toner image carrier and a pair of side portions extending from respective side edges of said lower portion toward said toner image carrier, and said shield member having a first opening in said lower portion, a second opening in one of said side portions adjacent said toner image carrier, and an open space facing said toner image carrier, and a cover member between said wire electrode and said toner image carrier, said cover member extending downstream from the upstream side of said wire electrode with respect to the direction of transport of the paper to cover a first part of said open space of said shield member to partially block said wire electrode from the toner image carrier while leaving a second part of said open space open for corona discharge by said wire electrode for transferring a toner image from said toner image carrier to a paper; and means for sucking air from the interior space of said shield member connected to said first opening for sucking air therethrough and causing outside air to flow into the interior space of said shield member through said second opening and said second part of said open space of said shield member.

2. The image forming apparatus as set forth in claim 1, wherein said second opening in one of said side portions of said shield member is located, from the upper edge of said side portion adjacent said toner image carrier, within one fourth the distance from said upper edge of said side portion to said lower portion.

3. The image forming apparatus as set forth in claim 1, wherein said cover member extends from the upper end of one of said side portions to cover said first part of said open space and partially block said wire electrode from said toner image carrier.

4. The image forming apparatus as set forth in claim 1, and further comprising:

a guide member disposed upstream of said corona discharge device with respect to the direction of transport of paper for guiding paper to a transfer region between said corona discharge device and said toner image carrier, wherein said cover member is attached to said guide member.

5. The image forming apparatus as set forth in claim 4, wherein:

said second opening in one of said side portions is bounded by said guide member and said side portion.

6. The image forming apparatus as set forth in claim 5, wherein said second opening in one of said side portions of said shield member is located, from the upper edge of said side portion adjacent said toner image carrier, within one fourth the distance from said upper edge of said side portion to said lower portion.

7. An image forming apparatus for transferring a toner image from a photosensitive drum onto paper transported in a direction of transport, comprising:

a corona discharge device for transferring a toner image on the photosensitive drum onto paper, said corona discharge device comprising:

a wire electrode to be disposed so as to extend in the axial direction of the photosensitive drum, and a stabilizer plate surrounding said wire electrode,e comprising a first side portion upstream of said wire electrode with respect to the direction of transport of paper covering said wire electrode on a first side thereof, a second side portion downstream of said wire electrode covering said wire electrode on a second side thereof, a third portion interconnecting said first and second portios at first ends thereof and covering said wire electrode at a third side thereof, and a fourth portion extending from a second end of said first side portion and partially covering said wire electrode on a fourth side thereof, a first opening disposed in said third portion, and a second opening disposed in said first side portion so as to be in proximity to the photosensitive drum, said second side portion and said fourth portion defining a discharge opening therebetween for corona discharge for transferring a toner image; and means for sucking air from the interior of said stabilizer plate out through said first opening, causing air to flow into said stabilizer plate from the outside through said second opening and through said discharge opening.

8. The image forming apparatus as set forth in claim 7, wherein:

said second opening in said first side portion is located, from said second end of said side portion, within one-fourth the distance from said second end to said first end.

9. An image forming apparatus for transferring a toner image from a photosensitive drum onto a paper transported in a direction of transport, comprising:

a corona discharge device for transferring a toner image on the photosensitive drum onto paper, said corona discharge device comprising:

a wire electrode to be disposed so as to extend in the axial direction of the photosensitive drum, and a stabilizer plate surrounding said wire electrode, comprising a first side portion upstream of said wire electrode with respect to the direction of transport of paper covering said wire electrode on a first side thereof, a second side portion downstream of said wire electrode covering said wire electrode on a second side thereof, and a third portion interconnecting said first and second portions at first ends thereof and covering said wire electrode at a third side thereof, said third portion having a first opening therein;

a guide member upstream of said corona discharge device with respect to the direction of transport of paper for guiding paper to a transfer region between said corona discharge device and the photosensitive drum;

a cover member attached to said guide member and extending downstream from the upstream side of said wire electrode to partly cover said wire electrode,e said cover member and said first portion defining a second opening therebetween to be disposed in proximity to the photosensitive drum, and said cover member and said second side portion defining a discharge opening therebetween for corona discharge for transferring a toner image; and means for sucking air from the interior of said stabilizer plate out through said first opening, causing air to flow into said stabilizer plate from the outside through said second opening and through said discharge opening.

10. The image forming apparatus as set forth in claim 9, wherein:

said second opening is located, from said cover member, within one-fourth the distance from said cover member to said first end of said side portion.

11. An image forming apparatus for transferring a toner image by corona discharge onto paper transported in a paper transport direction, comprising:

a photosensitive member for having a toner image formed thereon;

a corona discharge means confrontingly disposed with respect to said photosensitive member for transferring a toner image from said photosensitive member onto a paper, said corona discharge means comprising:

(a) electrode means for generating corona ions, (b) shield means for encompassing said electrode means about three sides thereof with first, second and third shield means portions, and having a fourth open portion for exposing said photosensitive member to and confronting said photosensitive member with said electrode means, (c) a first opening in said first portion, wherein said first portion is disposed opposite said fourth portion;

(d) a second opening in said second portion, wherein said second portion is disposed opposite to and upstream of said third portion with respect to the paper transport direction, and (e) a cover member located at said fourth portion and extending from the upstream side thereof for partially shielding said fourth portion; and means for sucking air to cause air to flow out of and into said shield means through said first and second openings.

12. The image forming apparatus as set forth in claim 11, wherein:

said second opening is located, from said cover member, within one-fourth the distance from said cover member to the opposite end of said second portion.

13. The image forming apparatus as set forth in claim 12, and further comprising:

a guide member upstream of said corona discharge device for guiding paper to a transfer region between said corona discharge device and said photosensitive member, wherein said cover member is attached to said guide member.

* * * * *

UNITED STATES PATENT AND TRADEMARK OFFICE

CERTIFICATE OF CORRECTION

PATENT NO. : 4,922,303

DATED : May 1, 1990

INVENTOR(S) : Katsuhiko TAKEDA and Misashi MYOCHIN

It is certified that error appears in the above-identified patent and that said Letters Patent is hereby corrected as shown below:

Column 4, line 33, change "tone" to --toner--.

Column 5, line 40, change "electrode,e" to --electrode--;
line 48, change "portios" to --portions--.

Column 6, line 31, change "e said" to --said--.

Signed and Sealed this

Twenty-second Day of October, 1991

*Attest:*

HARRY F. MANBECK, JR.

*Attesting Officer*

*Commissioner of Patents and Trademarks*